US008545199B2

(12) United States Patent
Koller et al.

(10) Patent No.: US 8,545,199 B2
(45) Date of Patent: Oct. 1, 2013

(54) REGULATABLE VANE-CELL PUMP WITH A SEALING WEB CURVING IN AN ARC

(75) Inventors: Johannes Koller, Vorchdorf (AT); Franz Wimmer, Vorchdorf (AT); Helmut Buchleitner, Seewalchen (AT); Helmut Pamminger, Vöcklabruck (AT); Michael Hiller, Gmunden (AT)

(73) Assignee: MIBA Sinter Holding GmbH & Co KG, Laakirchen (AT)

( * ) Notice: Subject to any disclaimer, the term of this patent is extended or adjusted under 35 U.S.C. 154(b) by 1087 days.

(21) Appl. No.: 11/989,654

(22) PCT Filed: Jul. 20, 2006

(86) PCT No.: PCT/AT2006/000309

§ 371 (c)(1),
(2), (4) Date: Aug. 4, 2009

(87) PCT Pub. No.: WO2007/012096

PCT Pub. Date: Feb. 1, 2007

(65) Prior Publication Data

US 2010/0008806 A1 Jan. 14, 2010

(30) Foreign Application Priority Data

Jul. 29, 2005 (AT) ..... 1279/2005

(51) Int. Cl.

| | |
|---|---|
| ***F01C 20/18*** | (2006.01) |
| ***F01C 20/22*** | (2006.01) |
| ***F04C 14/18*** | (2006.01) |
| ***F04C 14/22*** | (2006.01) |
| ***F04C 28/18*** | (2006.01) |
| ***F04C 28/22*** | (2006.01) |

(52) U.S. Cl.
USPC ..... 418/24; 418/26; 418/27; 418/30

(58) Field of Classification Search
USPC ..... 418/24, 26, 27, 29, 30, 31
See application file for complete search history.

(56) References Cited

U.S. PATENT DOCUMENTS

| | | | |
|---|---|---|---|
| 2,685,842 | A | 8/1954 | Hufferd |
| 3,687,579 | A | 8/1972 | Martin et al. |

(Continued)

FOREIGN PATENT DOCUMENTS

| | | |
|---|---|---|
| CN | 2052829 | 2/1990 |
| CN | 2408269 | 11/2000 |

(Continued)

OTHER PUBLICATIONS

International Search Report, mailed Apr. 2007.

(Continued)

*Primary Examiner* — Mary A Davis
(74) *Attorney, Agent, or Firm* — Collard & Roe, P.C.

(57) ABSTRACT

The invention relates to a vane pump (1), in particular a regulatable oil pump for a lubricating system, with a pump housing (2) with at least one housing tank (6) and with a vane rotor (11) disposed in the housing tank (6) mounted so that it can be rotated by means of a drive shaft (10) in the pump housing (2) constituting an axis of rotation (23) which provides a mount for vanes (15) in approximately radially extending fitting slots (14). An adjusting ring (27) is provided enclosing the vane rotor (11) and circumferentially bounding pump cells (26) which, by means of a cylindrical internal wall surface (31), can be displaced between a concentric position with respect to the vane rotor (11) and an eccentric position relative thereto, to which pressured is applied by positioning torques caused by the medium pressure and a positioning mechanism (47) in order to regulate a pressure level.

14 Claims, 12 Drawing Sheets

(56) References Cited

U.S. PATENT DOCUMENTS

| | | | | | |
|---|---|---|---|---|---|
| 4,531,893 | A | | 7/1985 | Okoh et al. | |
| 4,558,998 | A | * | 12/1985 | Kiyoshige et al. | 418/26 |
| 4,678,412 | A | * | 7/1987 | Dantlgraber | 418/26 |
| 5,083,909 | A | * | 1/1992 | Kunsemiller et al. | 418/102 |
| 5,188,522 | A | * | 2/1993 | Hara | 418/77 |
| 5,545,014 | A | * | 8/1996 | Sundberg et al. | 418/26 |
| 5,752,815 | A | * | 5/1998 | Muller | 418/26 |
| 2004/0247463 | A1 | | 12/2004 | Kiefer | |
| 2009/0022612 | A1 | * | 1/2009 | Williamson et al. | 418/24 |
| 2009/0074598 | A1 | * | 3/2009 | Tanasuca | 418/27 |

FOREIGN PATENT DOCUMENTS

| | | | |
|---|---|---|---|
| DE | 2 036 200 | | 2/1971 |
| DE | 25 51 451 | | 5/1977 |
| DE | 33 22 549 | | 3/1984 |
| DE | 33 34 919 | | 3/1984 |
| DE | 33 33 647 | | 5/1984 |
| DE | 195 33 686 | | 3/1997 |
| EP | 0 049 838 | | 10/1981 |
| EP | 0 051 192 | | 5/1982 |
| JP | 53-130505 | | 11/1978 |
| JP | 56-143383 | | 11/1981 |
| JP | 57-062986 | | 4/1982 |
| JP | 59-023092 | | 2/1984 |
| JP | 03-257990 | | 11/1991 |
| JP | 06-093978 | | 4/1994 |
| JP | 06093978 | A * | 4/1994 |
| JP | 10-205461 | | 8/1998 |
| JP | 10205461 | A * | 8/1998 |
| JP | 2004-044414 | | 2/2004 |
| WO | WO 03/069127 | | 8/2003 |
| WO | WO 2005/068838 | | 7/2005 |

OTHER PUBLICATIONS

English Translation of International Preliminary Report on Patentability.

* cited by examiner

REGULATABLE VANE-CELL PUMP WITH A SEALING WEB CURVING IN AN ARC

CROSS REFERENCE TO RELATED APPLICATIONS

This application is the National Stage of PCT/AT2006/000309 filed on Jul. 20, 2006 which claims priority under 35 U.S.C. §119 of Austrian Application No. A 1279/2005 filed on Jul. 29, 2005. The international application under PCT article 21(2) was not published in English.

The invention relates to a vane pump.

Document JP 56-143383 A discloses a regulatable vane pump with a positioning mechanism and an adjusting ring mounted in a pivot arrangement so that it can pivot about a pivot shaft in the pump housing extending parallel with an axis of rotation. In conjunction with the housing wall and seal arrangements, the adjusting ring forms a pressure chamber with a flow connection to a pressure region. The positioning mechanism comprises a spring arrangement in the form of a spiral compression spring opposing a pivoting movement of the pressurised adjusting ring with a spring force, which is disposed between a housing wall of the pump housing and a thrust bearing comprising a projection on the adjusting ring.

Document DE 25 51 451 A1 discloses a rotary piston pump which can be regulated by means of a control mechanism, with a vane rotor which can be rotated about an axis of rotation in a pump housing. A piston slide with a bore accommodating the vane rotor is mounted so that it can be displaced in the pump housing both linearly and relative to the vane rotor, and a bore diameter corresponds to approximately a rotor diameter plus a maximum extension of a vane, as a result of which a variable delivery cell volume can be achieved by means of the control mechanism, which controls the relative position of the piston slide by applying pressure to the piston slide.

Document U.S. Pat. No. 2,685,842 A discloses a regulatable vane pump, with a vane rotor mounted so that it can rotate in a pump housing and an adjusting ring enclosing it, and with a positioning mechanism for the adjusting ring. The adjusting ring is mounted in a bore of the pump housing so that it can rotate concentrically with the axis of rotation of the vane rotor and has a bore disposed eccentrically thereof for accommodating the vane rotor. In order to displace the adjusting ring, a positioning mechanism is provided in the form of a rack gearing with a toothed segment disposed on an external circumference of the adjusting ring, which meshes with driving means, e.g. a toothed pinion, toothed rod, mounted in the pump housing so that it can be hydraulically displaced so as to oppose the action of a spring arrangement.

Patent specification DE 33 22 549 A1 discloses a vane pump with a variable delivery stroke, with a rotor mounted in the pump housing so as to be rotatable about an axis of rotation with vanes disposed in radial slots, which is enclosed by an adjusting ring disposed in a pump chamber of the pump housing so that its position can be varied, and the adjusting ring is mounted in the pump chamber extending around a pivot axis extending parallel with the axis of rotation and can be displaced from a position concentric with the rotor into a position disposed eccentrically with respect to the rotor in order to vary the delivery stroke. The position of the adjusting ring is varied by regulating the pressure applied to pressure chambers extending on either side of the pivot bearing arrangement, separated from one another in a pressure-tight arrangement bounded by the external wall of the adjusting ring and the internal wall of the pump housing.

Another document, DE 195 33 686 A1, discloses a regulatable vane pump in the form of a lubricant pump, with a rotor with a plurality of radially displaceable vanes mounted so as to be rotatable in a pump housing, which is surrounded by an adjusting ring mounted so that it can pivot about a bolt in order to delimit pump cells, and which is mounted in the pump housing so that it can pivot about a bolt constituting a pivot axis extending parallel with the axis of rotation in order to vary an eccentricity of the adjusting ring with respect to the rotor. Extending on either side of the pivot bearing around the circumference of the adjusting ring in the pump housing are pressure chambers, which are separated from one another in a pressure-tight arrangement, one of which constitutes the suction pressure chamber whilst the other serves as the delivery pressure chamber, and pressure surfaces around the circumference of the adjusting ring to which pressure is applied are of approximately the same size.

Document WO 03 069 127 A1 discloses a regulatable vane pump, in which an annular rotor mounted in a pump housing so as to be rotatable about an axis of rotation is surrounded by an adjusting ring mounted in the housing about a pivot axis extending parallel with the axis of rotation and can be moved from a position coaxial with the rotor into an eccentrically disposed position in order to vary a delivery flow of a medium. Disposed in a central bore of the rotor is a vane star rotatably mounted on a shaft, which is attached to an end-wall disc of the adjusting ring and the axial orientation of which extends parallel with the axis of rotation. Vanes of the vane star extending in the radial direction extend through slots forming a sealed arrangement of the rotor ring guaranteeing a relative movement. This design enables a displacement of the adjusting ring together with the vane star between a concentric and an eccentric position with respect to the rotor ring, and the vanes of the vane star lie in a sliding arrangement against the internal wall of the adjusting ring irrespective of the position. This results in delivery cells with a variable volume between the rotor ring and adjusting ring and hence a regulatable delivery volume for varying a delivery pressure by means of a spring arrangement, which opposes a displacement of the adjusting ring due to the pressure applied to it in a region of its circumference.

The objective of the invention is to propose a vane pump which has small external dimensions and is therefore of compact construction so that it can be used very universally in conjunction with a motor or engine to be supplied with a lubricant.

This objective is achieved by the features of the invention. The surprising advantage of this approach is that pressure is applied directly to a limited circumferential region of the adjusting ring, resulting in a housing design which is suitable for mass production in terms of manufacturing technology and is thus economical, and the seal arrangements bounding the cavity are formed by the direct cooperation of the adjusting ring and housing, thereby obviating the need for additional seal elements which would be exposed to wear.

An embodiment is of advantage because it permits an arrangement whereby an adjusting ring can be disposed directly adjoining a pivot bearing arrangement, thereby resulting in short pivoting moments for regulation purposes.

In the case of an advantageous embodiment, an exactly defined working surface and hence positioning torque is achieved.

Also of advantage is an embodiment defined in claim 4, because it enables a stable mounting of the adjusting ring free of vibration to avoid pressure fluctuations.

In other advantageous embodiments, stop arrangements can be provided as a means of limiting the end positions of the pivot range of the adjusting ring without the need for additional components.

The advantage of another embodiment is that a sensitive regulation of the vane pump is achieved.

Also possible are embodiments resulting in an exact regulation characteristic so that vibrations in the pressure system are effectively prevented due to a clearance-free design of the positioning mechanism.

Another embodiment enables fitting without the need for additional components.

In another possible embodiment, the interior—and hence the external dimensions—of the vane pump can be kept small, thereby facilitating use even with small motors.

Another advantageous embodiment guarantees a stepless regulation of the vane pump's performance.

Another advantageous embodiment makes it easier to adjust the pressure level.

Other embodiments permit a design of the vane pump fit for different capacities using standardised components.

Another advantageous embodiment lends itself to mass production whilst conforming to the lowest manufacturing tolerances and producing high surface qualities, thereby obviating the need for expensive finishing processes.

As a result of another embodiment, the components are guaranteed a long service life.

Finally, other embodiments are of advantage because they lend themselves to cost-effective mass production with a high production quality.

In order to provide a clearer understanding, the invention will be described in more detail below with reference to examples of embodiments illustrated in the appended drawings.

BRIEF DESCRIPTION OF THE DRAWINGS

Of these.

DETAILED DESCRIPTION OF THE PREFERRED EMBODIMENTS

Figure 1:
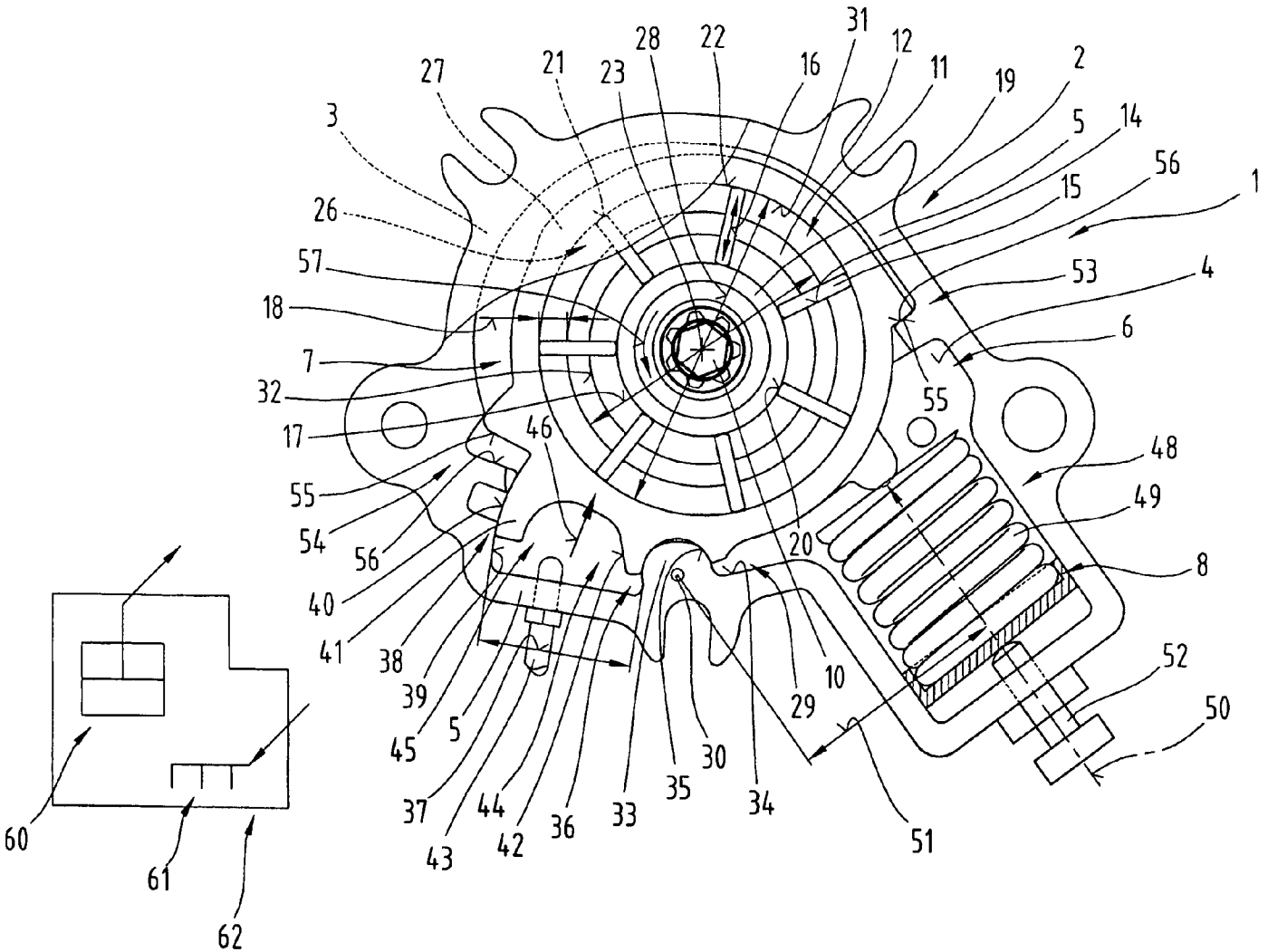
FIG. 1 is a plan view of the vane pump proposed by the invention with the end-wall cover removed.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Figure 2:
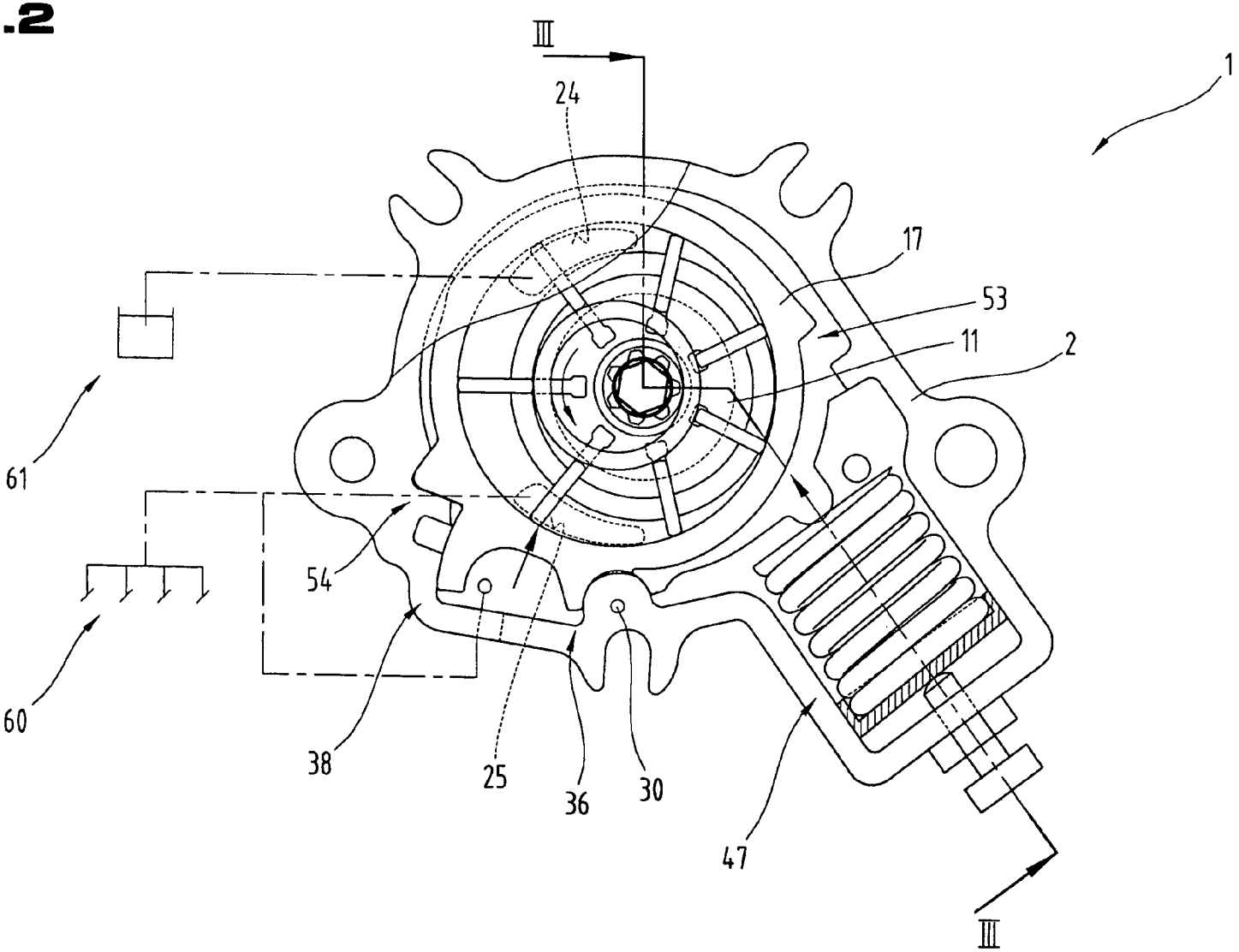
FIG. 2 is a plan view of the vane pump illustrated in FIG. 1 with the adjusting ring in the pivoted position.
Figure 3:
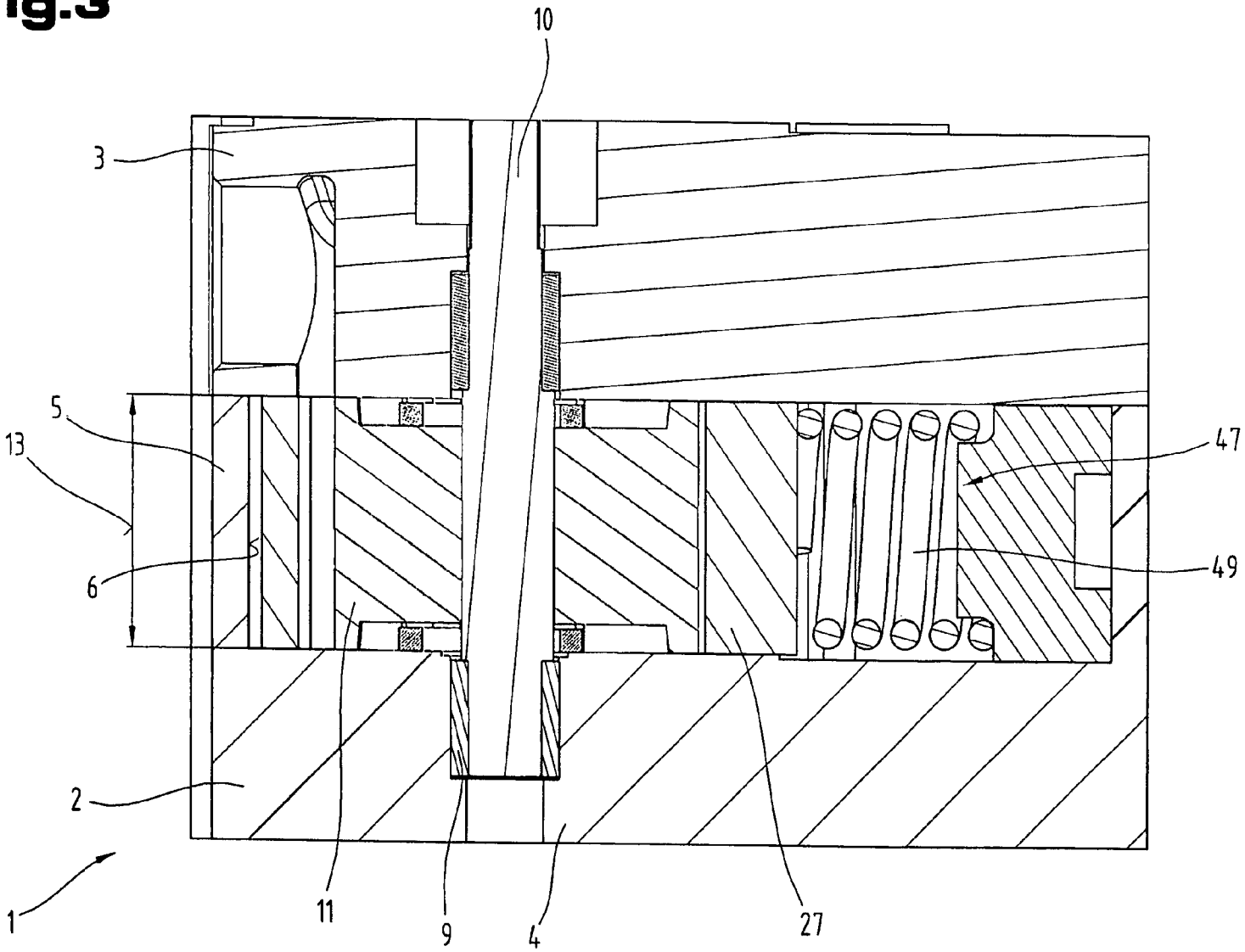
FIG. 3 is a view in section showing the vane pump along line III-III indicated in FIG. 2.

FIGS. 1 to 3 illustrate a regulatable vane pump 1 based on a plan view onto a pump housing with the cover part 3 partially removed. The pump housing 2 is an integral component, in particular a sintered metal component, and comprises a flat wall plate 4 with a circumferentially extending wall web 5, thereby forming a housing tank 6. One region of the housing tank 6 has an approximately circular contour, which merges into a tank region extending more or less at a tangent. The regions of the housing tank form a rotor chamber 7 and a control chamber 8.

Disposed in the pump housing 2 or wall plate 4 and the housing cover part 3, preferably in an anti-friction bearing 9, is a drive shaft 10 mounted with a vane rotor 11. The vane rotor 11 comprises a cylindrical rotor body 12, with what is preferably an uneven number of fitting slots 14 extending approximately in the radial direction across a height 13, in which plate-shaped vanes are mounted so that they can be displaced in the radial direction—indicated by double arrow 16. In a basic position in which all the vanes 15 extend out beyond an external diameter 17 of the rotor body 12 by an identical extension 18, a supporting ring 19 sits in a circular recess 18 of the rotor body 12, against the external circumference of which the vanes 15 are supported by end faces 20 directed towards the drive shaft 10. The supporting ring 19 is able to move in and relative to the recess 18 of the rotor body, thereby enabling a circumcircle 22 containing outer end faces 21 of the vanes 15 to assume an eccentric position by reference to an axis of rotation 23 of the vane rotor 11, as occurs in order to vary or regulate the delivery rate of the vane cells 1.

The medium is conveyed from a suction region 24 into a pressure region 25 when the vane rotor 11 is rotated, due to the pump cells 26 extending round the vane rotor 11, the volumes of which can be varied, as will be explained in more detail below. The pump cells 26 are bounded by the rotor body 12, the vanes 15 extending out from them and an adjusting ring 27 enclosing the vane rotor 11, which has an internal diameter 28 corresponding to at least the external diameter 17 of the rotor body plus two times the extension 18 of the vanes 15.

The dimensions of the vane rotor 11 in terms of its external diameter 17 and the extension 18 of the vanes 15 and hence the external diameter 17 as well as the height 13 of the rotor body 12 are selected on the basis of the desired operating range for the vane pump 1 making allowance for the specified speed range of the vane pump 1 as well as physical data pertaining to the medium to be pumped. The internal diameter 28 of the adjusting ring 27 is determined on the basis of these specifications.

The adjusting ring 27 is pivotably mounted in the housing tank 6 in a pivot bearing arrangement 29 forming a pivot axis 30 extending parallel with the axis of rotation 23, and in one end position—as illustrated in FIG. 1—an internal wall surface 31 is positioned concentrically to the circumferential surface 32 of the rotor body 12, and in another end position—illustrated in FIG. 2—assumes an eccentric position.

In the specific example illustrated, the pivot bearing arrangement 29 is formed by a wall rib 33 disposed on the wall web 5, in particular formed thereon, extending across a height 13 of the rotor body 12, which extends out from an internal face 34 of the wall web 5 with an approximately semi-circular cross-section. The adjusting ring 27 is mounted on this wall rib 33 by means of a semi-circular groove 35 in the cross-section. This design corresponds to an anti-friction mounting for pivoting the adjusting ring 27 about the pivot axis 30, which is defined by the contour of the wall rib 33 and groove 35. Since the design of the pivot bearing arrangement 29 is based on that of an anti-friction mounting and the surface quality that goes with it, a seal arrangement 36 is obtained between the different pressure levels prevailing on either side of the pivot bearing arrangement 29—which will be explained in more detail below.

Disposed at a distance 37 from the adjusting ring 27 in the circumferential direction is another seal arrangement 38 comprising sealing surfaces 39, 40 jointly formed on a sealing web 41 of the adjusting ring 27 and the wall web 5, which sealing surfaces 39, 40 curve in an arc about the pivot axis 30 due to the ability of the adjusting ring 27 to pivot.

The seal arrangements 36, 38 spaced at said distance 37 from one another together with the adjusting ring 27 and wall web 5 bound a cavity 42 which forms a pressure chamber 44 with a flow connection, e.g. a pressure line 43, connected to the pressure region 25 and in which a working surface 45 comprising the distance 37 and the depth of the housing tank 6 causes a displacement force—indicated by arrow 46—to act on the adjusting ring 27 so that it pivots into the concentric position illustrated in FIG. 1. A counter-torque opposes this torque acting on the adjusting ring 27 due to a positioning mechanism 47 disposed in the control chamber 8, e.g. a spring arrangement 48 with a helical compression spring 49.

A spring force—indicated by arrow 50—generates the counter-torque about the pivot axis 30 corresponding to a normal distance 51 and causes a displacement of the adjusting ring 27 into the eccentric position with respect to the rotor body 12, illustrated in FIG. 2, as long as no pressure or only a low pressure prevails in the cavity 42. The end position illustrated in FIG. 2 also corresponds to the non-operating position of the vane pump 1 before the start of pumping or building up pressure in the pressure region 25. The spring force—indicated by arrow 50—of the spring arrangement 48 can be adjusted in order to regulate a biasing force in a preferred embodiment, e.g. by means of an adjusting screw 52, compressing the helical compression spring 49 to a greater or lesser degree.

The end positions of the adjusting ring 27 are fixed by two stop arrangements 53, 54, obtained by providing oppositely lying stop surfaces 55, 56 in the form of co-operating depressions and projections on the wall web 5 and adjusting ring 27.

As described in connection with FIGS. 1 and 2, the adjusting ring 27 assumes the eccentric end position during operation when the vane rotor 11 is driven in the direction of rotation—indicated by arrow 57—i.e. by means of an auxiliary output of an internal combustion engine. The pump cells 26, which assume the shape of a sickle in this position, are connected to one another to permit a flow by means of approximately kidney-shaped orifices 58, 59 in the wall plate 4 and co-operating passages in the housing cover 3 to a supply tank 60, forming the suction region 24 and forming the pressure region 25 with supply lines 61 for lubricating points of an internal combustion engine 62.

Due to the varying volumes of the pump cells 26 as the vane rotor 11 rotates, medium is sucked into the suction region 24 as the volume increases, and as the vane rotor 11 is rotated farther thereby reducing the volume of the pump cells 26, the pressure in the pressure region 25 builds up. The pressure is then increased until the pivot torque caused by the pressure acting in the cavity—indicated by arrow 46—reaches the opposing pivot torque caused by the spring arrangement 48 due to the spring force—indicated by arrow 45. This means that the pressure level in the pressure region 25 can be adjusted to a predefined amount by means of the biasing action of the helical compression spring 49 and the pivot torques induced by it. As the pivot torque caused by the pressure comes close to the counter-torque caused by the spring arrangement 48, the adjusting ring 27 assumes positions between the two end positions, depending on the requirements and pressure conditions in a supply system 61, so that the delivery rate of the vane pump 1 is automatically regulated as a function of the predefined pressure. When the pressure rises, e.g. caused by a lower requirement of medium in the supply system 61, the delivery rate is reduced by moving the adjusting ring 27 in the direction of the concentric position, thereby preventing a further rise in pressure. If the pressure falls due to an increased requirement in the supply system 61, a pivoting movement into the eccentric position takes place, causing an increase in the delivery rate and hence a readjustment of the pressure level in order to reach the predefined pressure.

Figure 5:
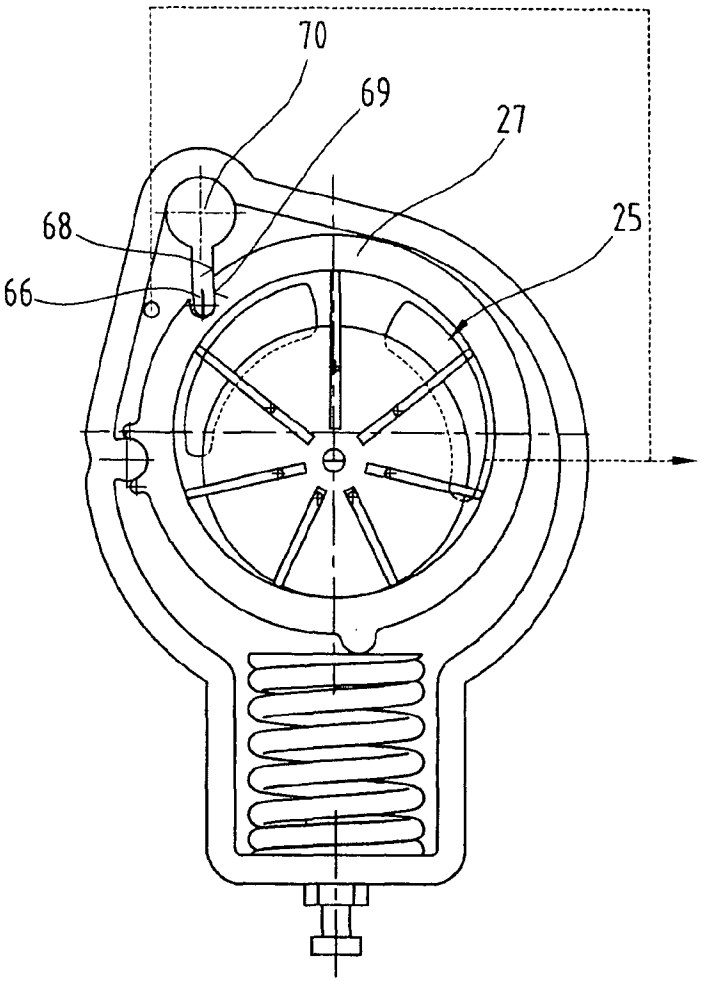
FIG. 5 shows the vane pump illustrated in FIG. 4 with the adjusting ring in the eccentric position.
Figure 4:
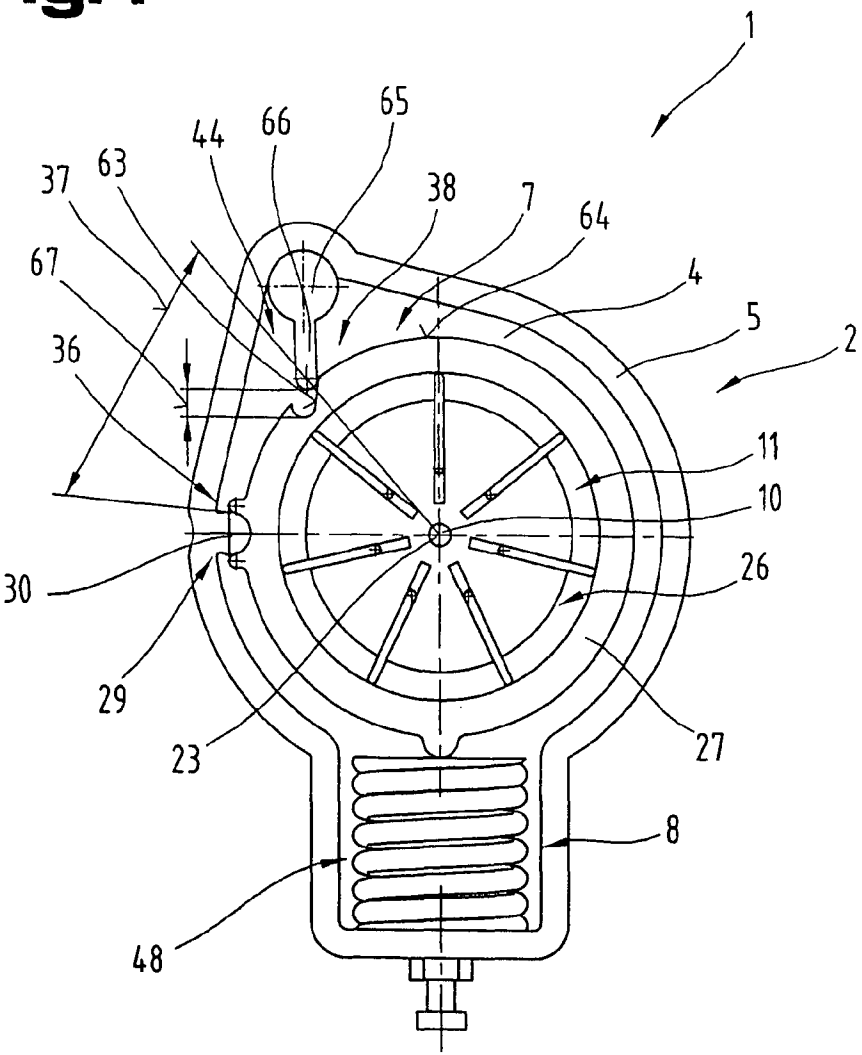
FIG. 4 illustrates another embodiment of the vane pump with the adjusting ring in the concentric position.

FIGS. 4 and 5 illustrate another embodiment of the vane pump 1 proposed by the invention, the same reference numbers and component names being used to denote parts that are the same as those described in connection with FIGS. 1 and 2 above. To avoid unnecessary repetition, reference may be made to the detailed description given in connection with FIGS. 1 to 3 above.

In this embodiment, the pump housing 2 together with the housing tank 6 constitute the rotor chamber 7 and control chamber 8 as described above. The vane rotor 11 mounted on the drive shaft 10 so that it can rotate about the axis of rotation 23 is mounted in the predominantly circular rotor chamber 7. Enclosing the vane rotor 11, the adjusting ring 27 is mounted in the pivot bearing arrangement 29 forming the pump cells 26 and can be pivoted between the position disposed concentrically with the vane rotor 11, as illustrated in FIG. 4, and the eccentric position illustrated in FIG. 5. The pivot bearing arrangement 29 is pressure-tight, being provided with the seal arrangement 36. In the embodiment illustrated as an example here, the other seal arrangement 38 disposed circumferentially at the distance 37 on the adjusting ring 27 comprises a groove-shaped recess 63 on a circumferential surface 64 of the adjusting ring 27 and a seal element 65. The pressure chamber 44 is disposed between the seal arrangements 36, 38. The seal element 65 sits in a sealing engagement with a strip seal 66 in the recess 63 of the adjusting ring 27 and is able to effect a relative sliding movement. A displacement path of the strip seal 66 in the recess 63 guarantees a sealing contact between oppositely lying sealing surfaces 68, 69 between the strip seal 66 and adjusting ring 27 both in the concentric end positions and in the eccentric end position of the adjusting ring 27. The seal element 65 is also mounted in the pump housing so that it can rotate about the pivot axis 50 extending parallel with the axis of rotation 23 in order to adjust an angular position as the adjusting ring 27 is displaced. However, it is also possible to opt for a stationary arrangement of the seal element, e.g. by choosing a resiliently elastic design for the strip seal 66 co-operating with the recess 63.

As also described above, the pressure chamber 44 has a flow connection to the pressure region 25, as indicated by broken lines.

The distance 37 between the seal arrangements 36, 38 is dimensioned so that the working surface 45 for applying pressure to the circumferential surface 64 of the adjusting ring is between 5% and 45% of the total circumferential surface 64 of the adjusting ring 27. The pivot torque of the adjusting ring 27 which occurs about the pivot axis 30 when pressure is applied opposes the positioning mechanism 47 formed by the spring arrangement 48 in the same way as described in connection with the preceding drawings, and this will therefore not be described in detail again.

Figure 6:
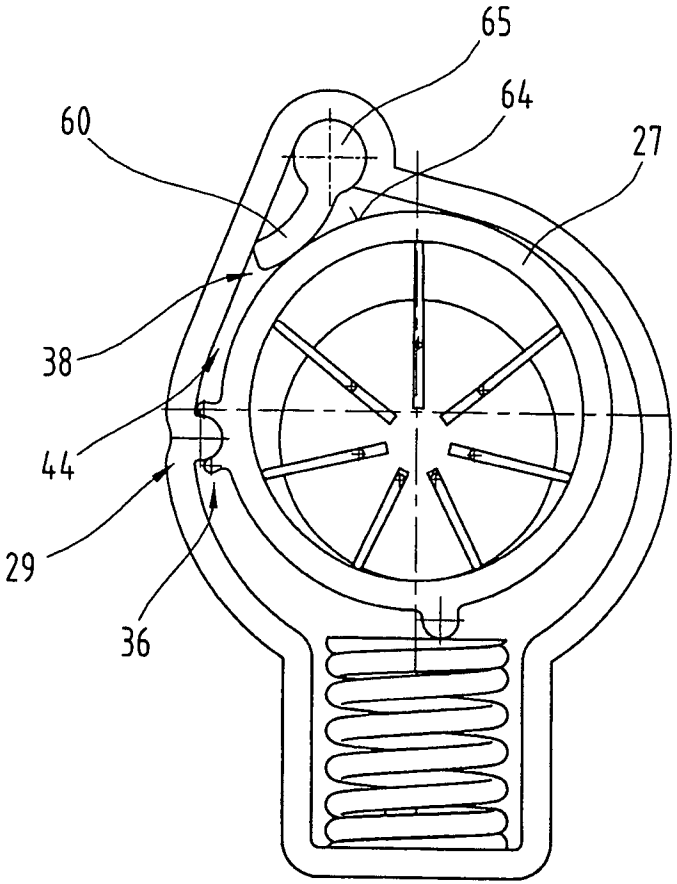
FIG. 6 illustrates another embodiment of the vane pump with an elastic seal element.

FIG. 6 illustrates the embodiment with a pivotable seal element 65, where the strip seal 66 lies against it at a tangent regardless of the position of the adjusting ring 27 due to the medium pressure in the pressure chamber and thus establishes a linear sealing contact on the circumferential surface 64 of the adjusting ring 27. This constitutes the seal arrangement 36. The cavity 42 or pressure chamber 44 is bounded by it and the other seal arrangement 38 formed by the pivot bearing 29. As may be seen from FIG. 5, the strip seal 66 is of a curved shape in the direction of the cavity, as a result of which the strip seal 66 sits with its surface in a sliding arrangement on the circumferential surface 64 of the adjusting ring.

Figure 8:
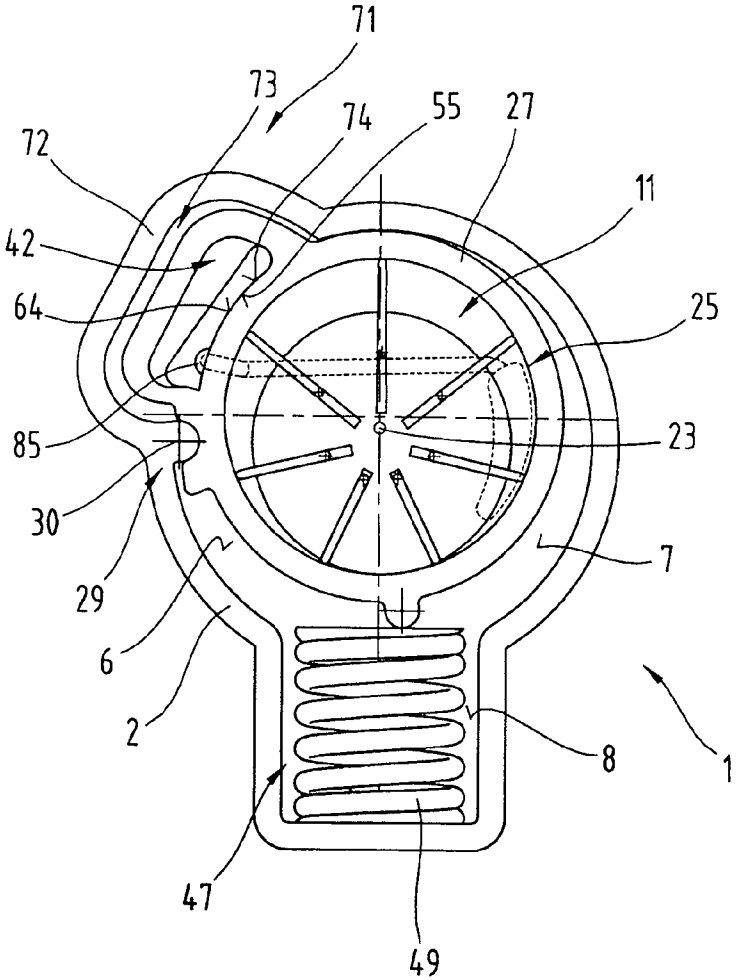
FIG. 8 shows the vane pump illustrated in FIG. 7 with the adjusting ring in the eccentric position.
Figure 7:
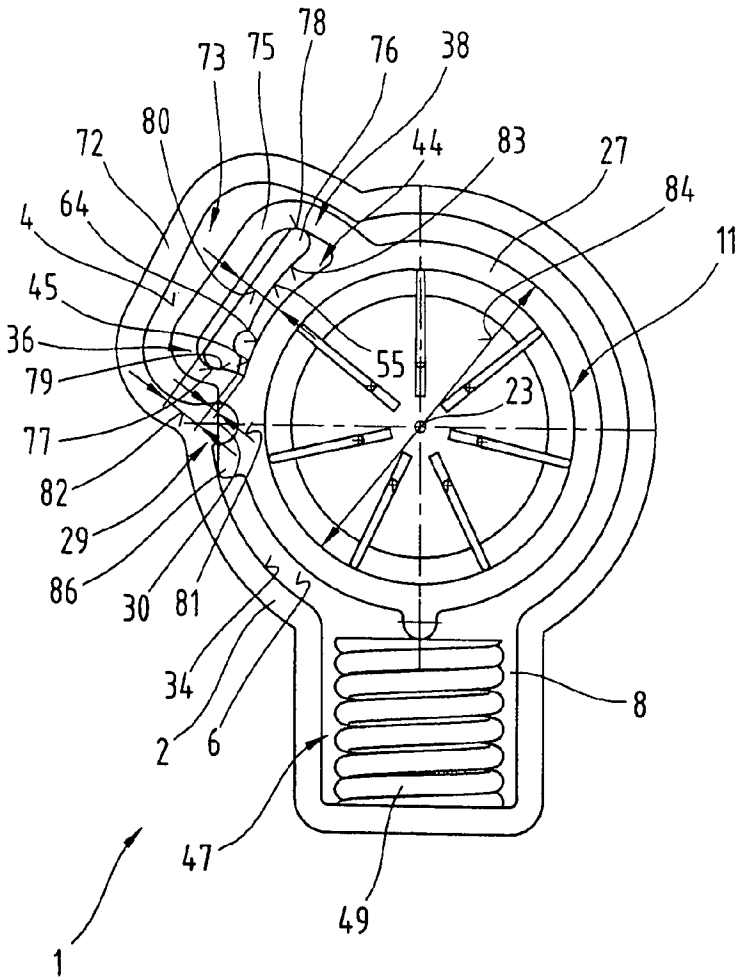
FIG. 7 illustrates another embodiment of the vane pump with a housing chamber constituting the pressure chamber formed by a housing extension, with the adjusting ring in the concentric position.

FIGS. 7 and 8 illustrate another embodiment of the vane pump 1, FIG. 7 showing the adjusting ring 27 in the concentric position with respect to the vane rotor 11 and FIG. 8 showing the maximum eccentric position. The adjusting ring 27 is mounted in the housing tank 6 or rotor chamber 7 of the pump housing 2 by means of a pivot bearing arrangement 29 so that it can pivot about the pivot axis 30 extending parallel with the axis of rotation 23 of the vane rotor 11, as explained in connection with the preceding drawings.

As also described above, the pump housing 2 also constitutes the control chamber 8 incorporating the helical compression spring 49 of the positioning mechanism 47.

In another region, the pump housing 2 has a U-shaped housing extension 71 directly adjoining the pivot bearing arrangement 29 and extending out from the external contour of the pump housing 2. Together with a surrounding peripheral web 72, it forms a housing chamber 73. The latter is bounded by the base-end wall plate 4 of the pump housing 2 and the peripheral web 72 integrally joined to the wall plate 4 and extends across approximately a quarter of the external contour of the pump housing 2. Extending out from the adjusting ring 27 and in particular integrally formed with it on an external circumference 74 is a U-bracket-shaped web 75 which extends the housing chamber 73 and forms an intrinsically closed cavity 42 extending along the external circumference 74 in conjunction with a region of the circumferential surface 64 of the adjusting ring 27. A sealing web 76 is provided in the cavity 42 on the base-end wall plate 4, which extends longitudinally in the direction of the cavity 42 and lies in a sealing arrangement on oppositely lying internal faces 79 of the web 75 by means of end faces 77, 78 extending perpendicular to the wall plate 4. This constitutes the seal arrangements 36, 38 for the pressure chamber 44 formed between the sealing web 76 and external face 64 of the adjusting ring 27. The end faces 77, 78 of the sealing web 76 and the internal faces 79 of the web 75 facing them have a mutually adapted external contour which guarantees an exact sealing contact, irrespective of the position of the adjusting ring 27 within the pivot range about the pivot axis 30. An internal width 80 of the cavity 44 is slightly bigger than the maximum pivot distance 81 plus a maximum thickness 82 of the sealing web 76. The positioning of the sealing web 76 on the wall plate 4 and a contact surface 63 of the sealing web 76 facing the adjusting ring 27 in a curvature is adapted to an external diameter 84 of the adjusting ring, and the sealing web 76 in conjunction with the contact surface 83 therefore forms the stop surface 55 which restricts the maximum pivot distance of the adjusting ring 27 in the eccentric position. A groove-shaped recess 84 is also provided in the contact surface 83 extending across a total height of the sealing web 76, in which the medium pressure taken from the pressure region 25 of the vane pump 1 via a connecting passage, connecting line, etc., prevails. Due to the action of the pressure on the working surface 45 formed by the surface region of the adjusting ring 27 in the cavity 42, the torque generated about the pivot axis 30 which moves the adjusting ring between the two end positions in the coaxial orientation with the vane rotor 11 or the eccentric orientation with respect to the vane rotor 11 varies as a function of the pressure level, and a displacement into the coaxial position opposes the torque about the pivot axis 30 caused by the helical spring 49 of the positioning mechanism 47. Depending on the choice or setting of the spring force based on an appropriate pre-tensioning, the pressure in the pressure region 25 is automatically regulated to the selected level. If the pressure in the pressure region drops below a value which is predetermined by the set levels of the pivoting torques and the pivoting torque therefore falls below the pivoting torque caused by the helical compression spring, the adjusting ring 27 is moved in a direction in which the eccentricity is increased. The delivery rate of the vane pump 1 is increased as a result, which is tantamount to an increase in pressure in the pressure region 25. The pivoting torques are compensated as a result and the adjusting ring 27 is adjusted to an intermediate position between the coaxial and eccentric position of the adjusting ring 27, in which the delivery rate is adapted to maintain the pressure.

If, as described above, the contact surface 83 acts as the stop surface 55 for restricting the end of the pivoting movement of the adjusting ring 27 for the eccentric position on the one hand, the other end position for the concentric position of the adjusting ring 27 is restricted by a stop cam 86 on the adjusting ring in the region of the pivot bearing arrangement 29, which moves into contact with the internal face 34 of the pump housing 2 or wall web 5 when the adjusting ring 27 is in the concentric position.

The design of the cavity 42 on the adjusting ring 27 therefore enables the design of the working surface 64 to be in the range proposed by the invention of between approximately 5% and 45% of the total circumferential surface 64 of the adjusting ring 27.

Figure 10:
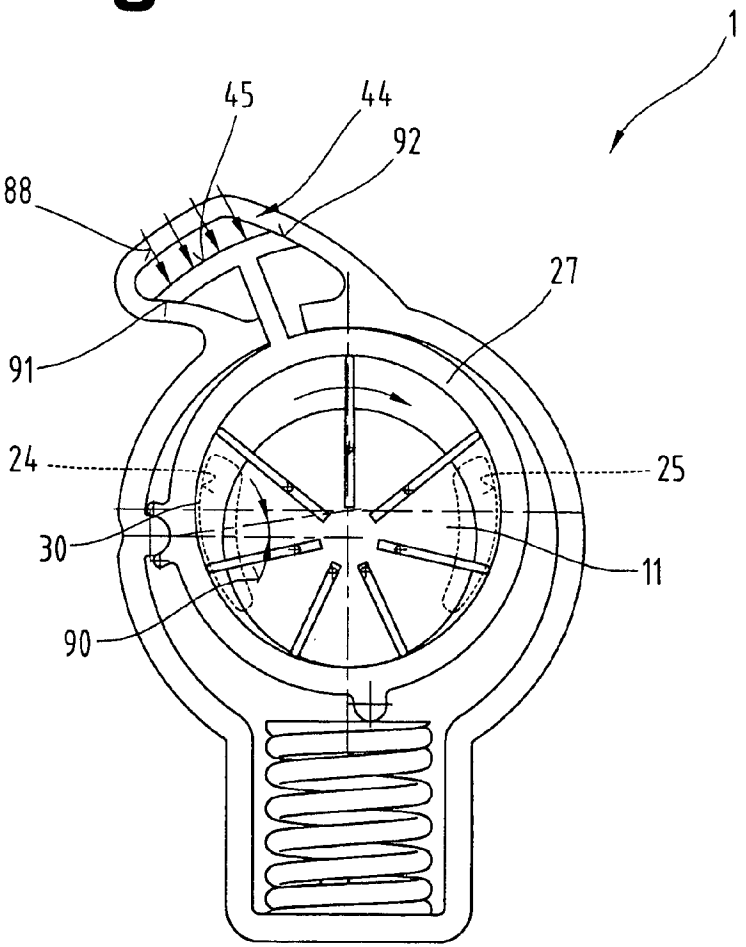
FIG. 10 shows the vane pump illustrated in FIG. 9, with the adjusting ring in the eccentric position.
Figure 9:
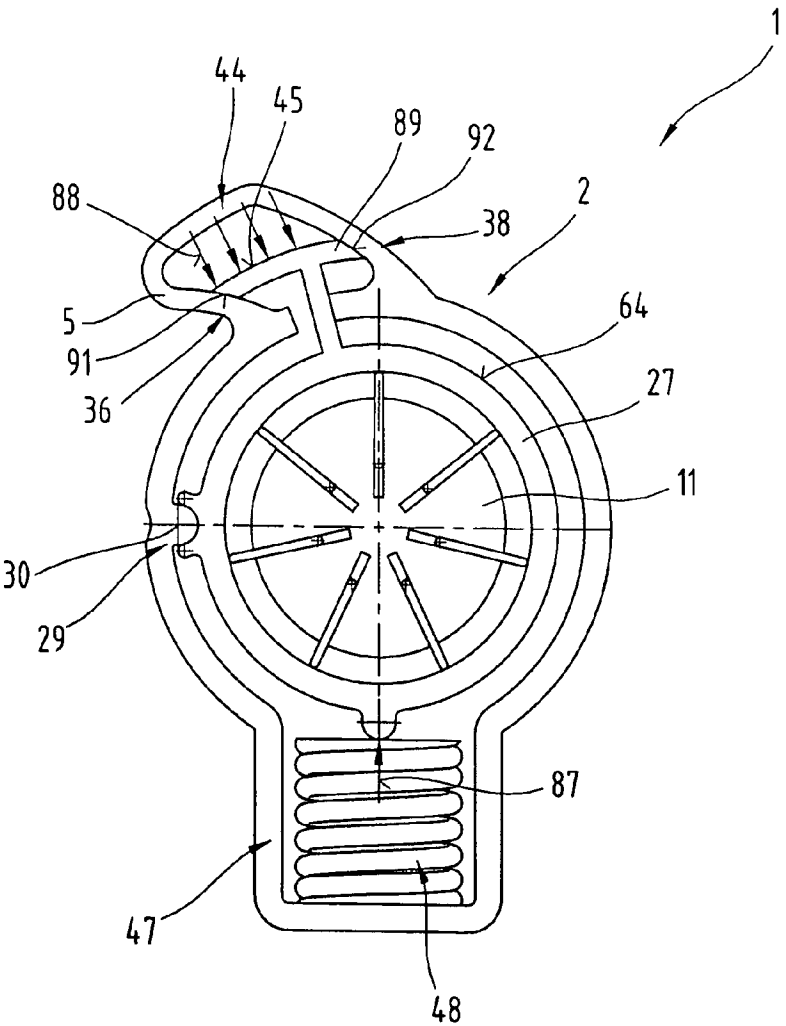
FIG. 9 illustrates another embodiment of the vane pump with a gasket formed on the adjusting ring to which medium pressure can be applied, with the adjusting ring in the concentric position.

FIGS. 9 and 10 illustrate another embodiment of the vane pump 1, and the adjusting ring 27 is again shown in its two end positions. The adjusting ring 27 is mounted so that it is able to pivot about the pivot bearing arrangement 29 formed between the wall web 5 of the pump housing 2 and the adjusting ring 27 and about the pivot axis 30 formed by it between the concentric position illustrated in FIG. 8 and the eccentric position illustrated in FIG. 9 with respect to the vane rotor 11, and the pivoting torque is applied by the spring arrangement 48 of the positioning mechanism 47—indicated by arrow 87. The counter-torque is caused by a force—indicated by arrow 88—resulting from the medium pressure in the pressure chamber 44 which prevails at the working surface 45 of a gasket 89 disposed in the pressure chamber 44 which is connected to the adjusting ring 27 so that it is moved with it.

The pressure chamber 44 has a flow connection via a connecting passage to the pressure region 25 of the vane pump 1. The design of the gasket 89 and the pressure chamber 44 guarantees a sealed contact and hence the seal arrangements 36, 38 between end faces 91, 92 of the gasket 89 and the wall web 5 irrespective of the pivot angle—indicated by arrow 90. The working surface 45 constitutes between approximately 5% and 45% of a total circumferential surface 64 of the adjusting ring 27.

Figure 11:
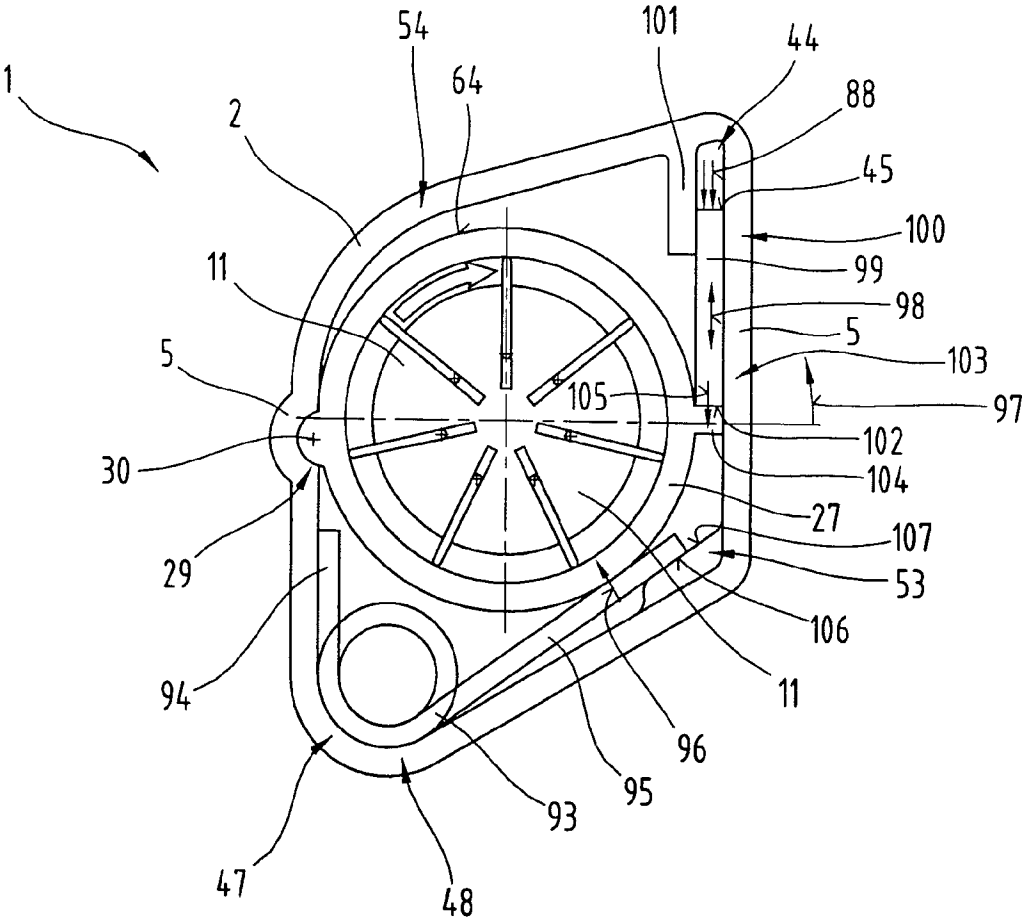
FIG. 11 illustrates another embodiment of the vane pump with the positioning mechanism.

FIG. 11 illustrates another embodiment of the vane pump 1. As described in connection with the other drawings above, the adjusting ring 27 is mounted in the pivot bearing arrangement 29 on the wall web 5 of the pump housing 2 so that it can pivot about the pivot axis 30. In the embodiment illustrated as an example here, the adjusting ring 27 is shown in its concentric position with respect to the vane rotor 11. The spring arrangement 48 of the positioning mechanism 47 in this embodiment is provided in the form of a helical torsion spring 93 with projecting spring legs 94, 95, one of which is supported on the wall web 5 whilst the other transmits a spring force—indicated by arrow 96—to the adjusting ring 27 in the direction in which it pivots—indicated by arrow 97—into the eccentric position. The opposing pivoting movement for regulating the vane pump 1, which is dependent on the medium pressure, is applied to the adjusting ring 27 by means of a displaceable positioning element 99 which is able to slide along the wall web 5—as indicated by double arrow 98—which is provided in the form of a flat plate extending at an end region 100 into the pressure chamber 44, formed between the wall web 5 and a wall portion 101 extending parallel with it projecting away from the wall web 5 and extending into the housing tank 6. An end face 102 of a freely projecting end region 103 of the plate acts on a positioning projection 104 extending out from the external circumference of the adjusting ring 7. The medium pressure—indicated by arrow 88—on the working surface 45 generates the positioning force—indicated by arrow 105—for the adjusting ring 27. The stop arrangements 53, 54 are provided in the form of stop surfaces 106, 107 of the spring leg 95 and a wall rib 108 for the concentric position of the adjusting ring 27 on the one hand and, for the eccentric position, by the contact of the circumferential surface 64 of the adjusting ring 27 on the internal face 34 of the wall web 5 on the other hand.

Figure 12:
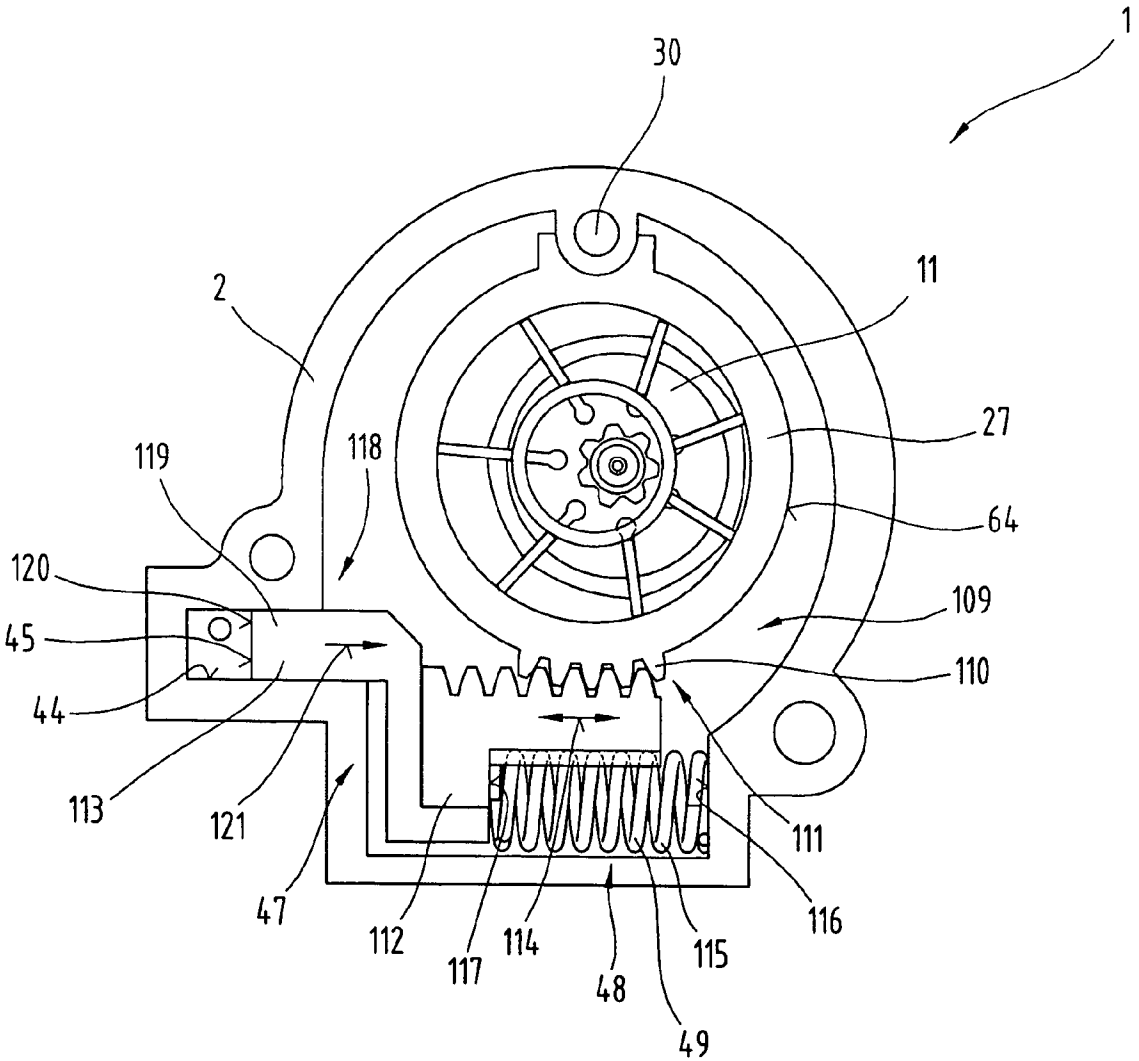
FIG. 12 illustrates another embodiment of the vane pump with a positioning mechanism in the form of a rack and pinion drive.

FIG. 12 illustrates another embodiment of the vane pump 1. The drawing illustrates the position of the adjusting ring 27 pivoted about the pivot axis 30 into the eccentric position with respect to the vane rotor 11. The positioning mechanism 47 in this embodiment comprises a rack and pinion drive 109 biased by the spring arrangement 48 in the direction of the eccentric position, in which a toothed segment 111 with a plurality of teeth 110 extends out from the circumferential surface 64 of the adjusting ring 27 and is preferably integrally formed on it.

Meshing with the latter is a multi-part toothed rack 112 which can be displaced linearly—as indicated by double arrow 114—by a slide 113 linearly guided in the pump housing 2 in order to pivot the adjusting ring 27. A helical compression spring 115 biases the toothed rack 112 and slide 113 and is supported on a wall region 116 of the pump housing 2 on the one hand by a contact with the toothed rack 112 or slide 113 on the other hand. The slide 113 projects by means of a projection 119 serving as a pressure piston 118 into the pressure chamber 44 formed in the pump housing 102, which has a flow connection to the pressure region 25 of the vane pump 1. An end face 120 of the projection 119 constitutes the working surface 45, at which the medium pressure for moving the slide 113—indicated by arrow 121—and hence the toothed rack 112 is generated, as a result of which the adjusting ring 27 is moved into the concentric position with respect to the vane rotor 11.

The toothed rack 112 comprises at least two leaf-shaped toothed racks with an identical tooth profile, which are mounted so that they can be displaced relative to one another in the direction of longitudinal extension, one of them being secured to the slide 113 in a driven connection, whilst pressure is applied to the other by the helical compression spring 49. This compensates for any backlash of the rack and pinion drive 109.

Figure 13:
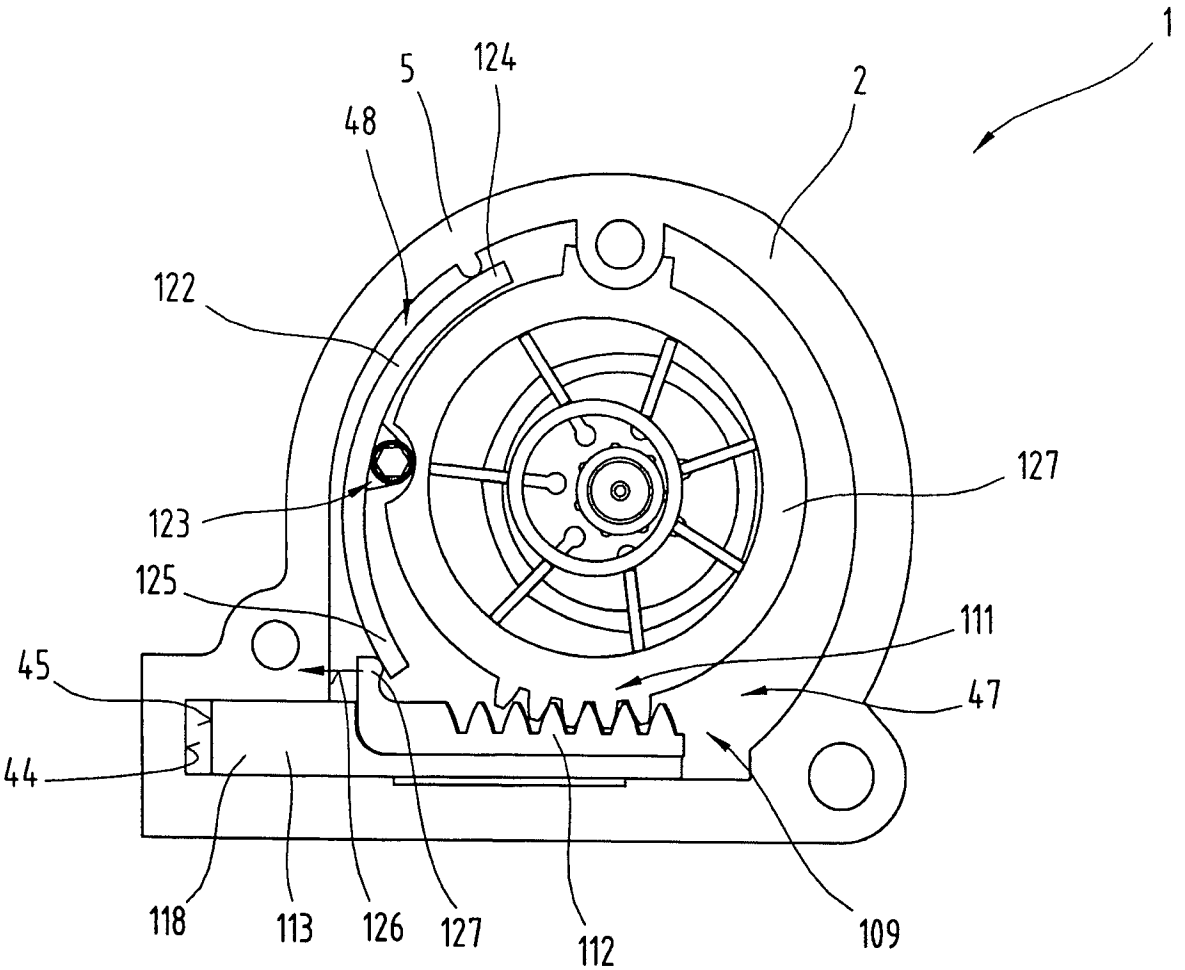
FIG. 13 illustrates another embodiment of the positioning mechanism of the vane pump.

FIG. 13 illustrates a different embodiment of the vane pump 1. As was the case with the drawing described above, the positioning mechanism 47 comprises the rack and pinion drive 109 with the slide 113, the toothed rack 112 and the toothed segment 111 on the adjusting ring 27. Also as described in connection with the preceding drawing, the slide 113 extends with the projection 119 acting as the pressure piston 118 into the pressure chamber 44.

The spring arrangement 48 of the positioning mechanism 47 in the embodiment illustrated as an example here comprises a leaf spring 122 enclosing the adjusting ring 27 at a distance apart from it and approximately conforming to the circumferential surface 64 in terms of its curvature. It is more or less centrally linked via a pivot bearing 123 to the adjusting ring 27 and is supported by means of a protruding spring arm 124 on the wall web 5 of the pump housing 2 or a rib-type projection on the internal face of the wall web 5 and has another spring arm 125 extending out from the pivot bearing 123 for biasing the slide 113 and toothed rack 112 in the direction of the pressure chamber 44—indicated by arrow 126—against a shoulder web 127 of the toothed rack 112. When pressure is applied to the working surface 45 formed by the pressure piston 118 in the pressure chamber 44, once the biasing force applied by the leaf spring 122 is overcome, the adjusting ring 27 is moved out of the eccentric position illustrated in FIG. 13 into the concentric position as soon as the predefined pressure level is reached in the pressure chamber 44 due to the biasing action of the leaf spring 122.

The backlash of the rack and pinion drive 109 is also compensated in the manner described above.

Figure 14:
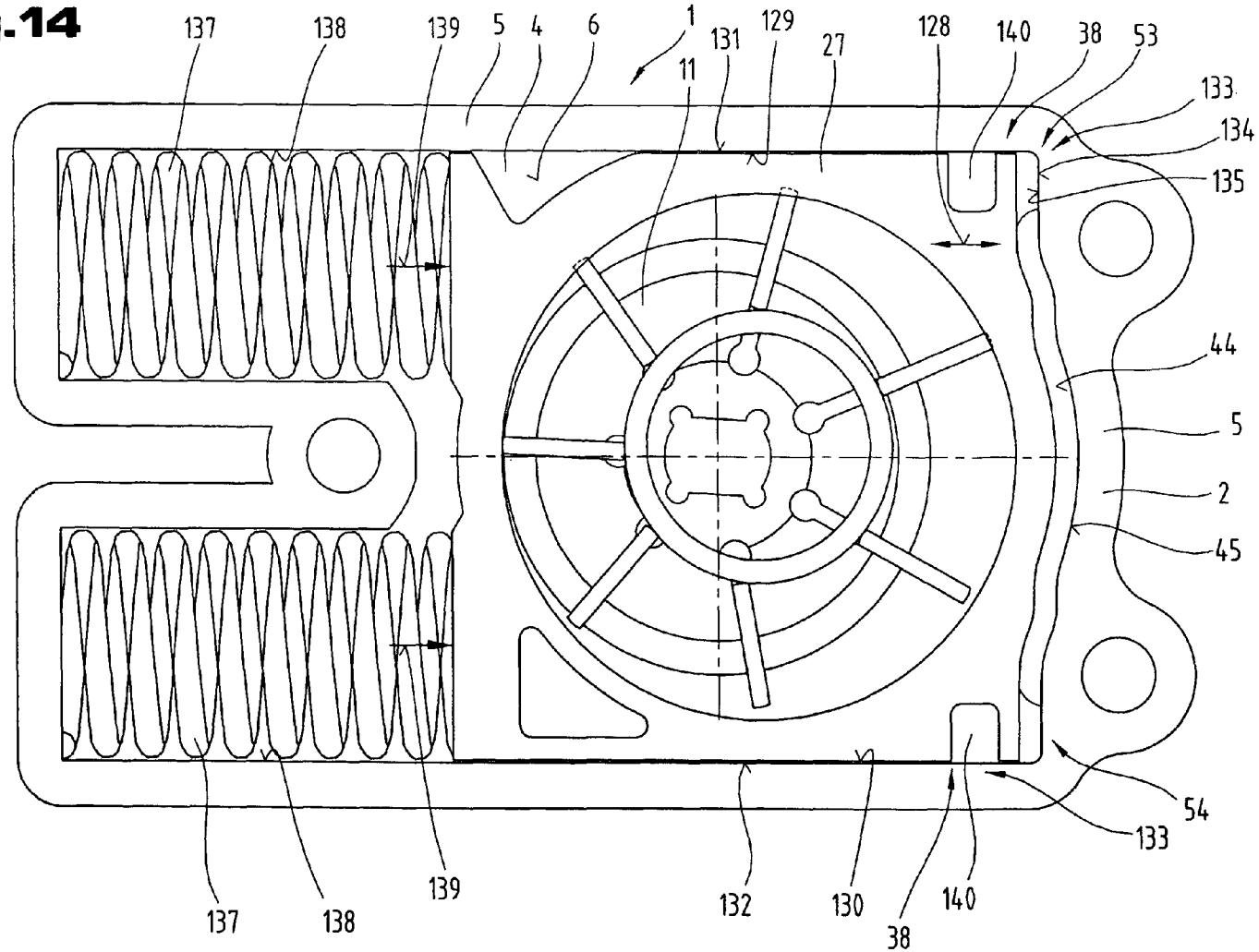
FIG. 14 illustrates another embodiment of the vane pump with a linearly displaceable adjusting ring.

FIG. 14 illustrates another embodiment of the vane pump 1. In this case, the adjusting ring 27 is disposed in the housing tank 6 formed by a base-end wall plate 4 and the wall web 5 so that it can be moved in the linear direction—indicated by double arrow 128—and oppositely lying internal wall surfaces 129, 130 of the pump housing 2 and side faces 131, 132 of the adjusting ring 27 form a linear guide arrangement 133.

As illustrated in the drawing, the adjusting ring 27 is shown in the pump housing 2 in the eccentric end position in abutment with mutually opposite stop surfaces 134, 135 between the wall web 5 and the adjusting ring 27. The pressure chamber 44 with the flow connection to the pressure chamber 25 of the vane pump 1 is formed due to the fact that a gap is left free between the wall web 5 and the working surface 45 between the stop arrangements 53, 54 constituting the end face.

In the embodiment illustrated as an example here, the positioning mechanism 47 comprises 2 helical compression springs 137 disposed in spring chambers 138 provided in the housing and the adjusting ring 27 is biased in the direction of the eccentric position by the biasing action of the helical compression springs 137—indicated by arrow 139.

The biasing force of the helical compression springs 137 is predefined in accordance with the desired pressure level. As the pressure rises, the adjusting ring 27 is moved in the direction of the concentric position by reference to the vane rotor 11.

In a preferred embodiment, linear seal elements 140 are provided in the side faces 131, 132 of the adjusting ring 27, which constitute the seal arrangements 36, 38 between the adjusting ring 27 and housing web 5.

Figure 15:
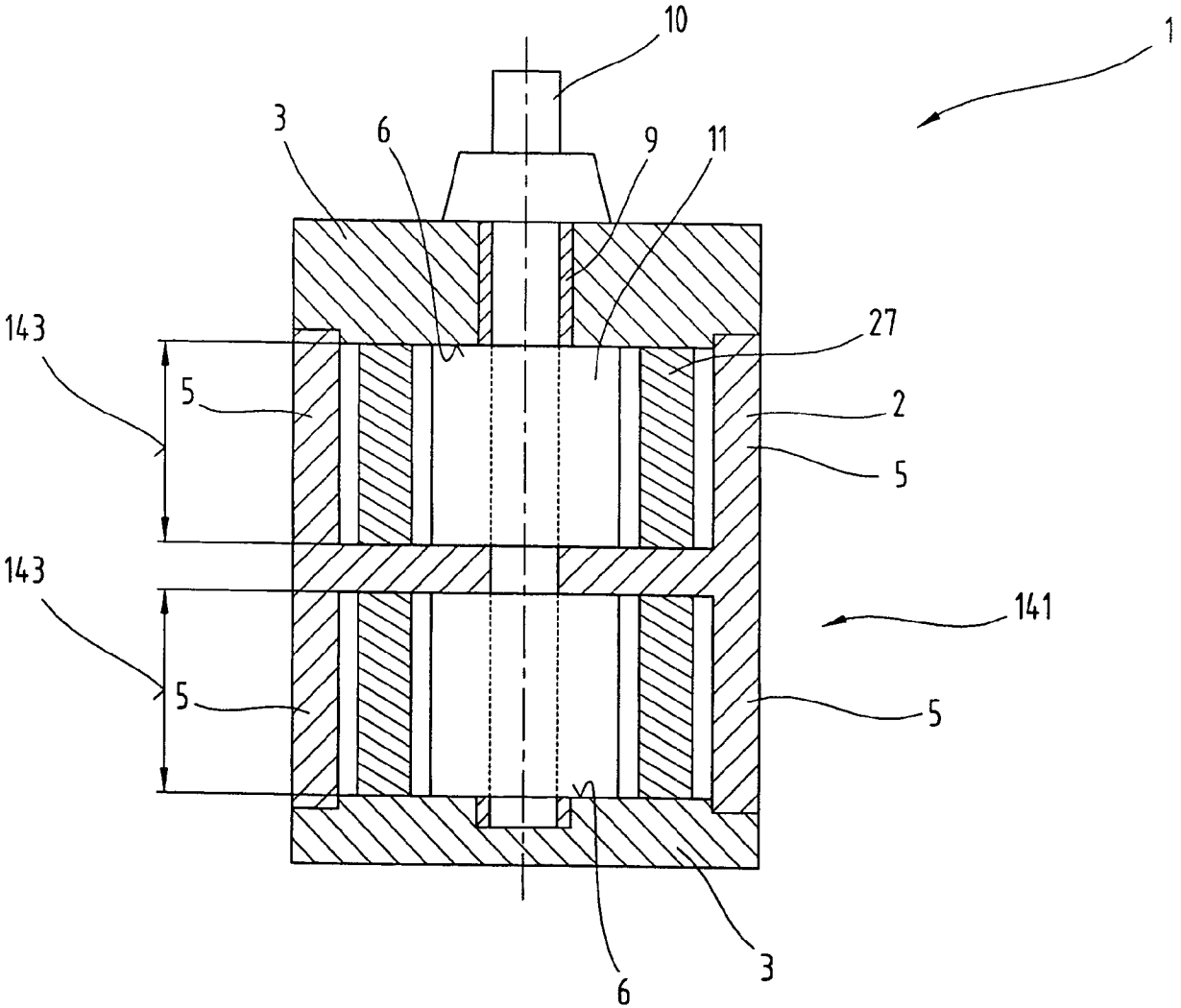
FIG. 15 illustrates another embodiment of the vane pump based on a tandem design.

FIG. 15 illustrates another embodiment of the vane pump 1 based on the design of a tandem pump 141. The pump housing 2 in this instance has two housing tanks 6 disposed in a complementary arrangement on a central wall 142, bounded by the latter and the wall webs 5. Disposed on a common drive shaft 10 in each of the housing tanks 6 is a vane rotor 11, enclosed by an adjusting ring 27 in each case.

The designs used for the vane rotor 11, adjusting ring 27 and positioning mechanism, not illustrated, may correspond to one of the designs described above in connection with the other drawings or a combination of them.

The embodiment illustrated may be designed for an identical or different depth 143 of the two housing tanks 6.

This design enables the performance range of a vane pump 1 of this type to be specified within broad ranges—using identical components, e.g. series of components based on predefined sizes.

In a preferred embodiment, the pump housing 2 and rotor body 12 are moulded parts made from sintered metal. For the housing cover 3, it is preferably to use cast Al-parts. The drive shaft 10 and vanes 15 are preferably made from steel.

Sintered metal components offer a high, constant quality standard due to the manufacturing process and enable manufacturing tolerances to be kept to the minimum. As a result, such components are often ready for use without the need for cost-intensive finishing processes.

The embodiments illustrated as examples represent possible variants of the vane pump 1 and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the of the vane pump 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1 to 15 constitute independent solutions proposed by the invention in their own right. The objectives and associated solutions proposed by the invention may be found in the detailed descriptions of these drawings.

LIST OF REFERENCE NUMBERS

1 Vane pump
2 Pump housing
3 Housing cover
4 Wall plate
5 Wall web
6 Housing tank
7 Rotor chamber
8 Control chamber
9 Anti-friction bearing
10 Drive shaft
11 Vane rotor
12 Rotor body
13 Height
14 Fitting slot
15 Vane
16 Double arrow
17 External diameter
18 Extension
19 Supporting ring
20 End face
21 Outer end face
22 Circumcircle
23 Axis of rotation
24 Suction region
25 Pressure region
26 Pump cell
27 Adjusting ring
28 Internal diameter
29 Pivot bearing arrangement
30 Pivot axis
31 Internal wall surface
32 Circumferential surface
33 Wall rib
34 Internal face
35 Groove
36 Seal arrangement
37 Distance
38 Seal arrangement
39 Sealing surface
40 Sealing surface
41 Sealing web
42 Cavity
43 Pressure line
44 Pressure chamber
45 Working surface
46 Arrow
47 Positioning mechanism
48 Spring arrangement
49 Helical compression spring
50 Arrow
51 Normal distance
52 Adjusting screw
53 Stop arrangement
54 Stop arrangement
55 Stop surface
56 Stop surface
57 Arrow
58 Orifice
59 Orifice
60 Supply container
61 Supply line
62 Internal combustion engine

63 Recess
64 Circumferential surface
65 Seal element
66 Strip seal
67 Displacement
68 Sealing surface
69 Sealing surface
70 Pivot axis
71 Housing extension
72 Peripheral web
73 Housing chamber
74 External circumference
75 Web
76 Sealing web
77 End face
78 End face
79 Internal face
80 Width
81 Pivot distance
82 Thickness
83 Control surface
84 External diameter
85 Recess
86 Stop cam
87 Arrow
88 Arrow
89 Gasket
90 Arrow
91 End face
92 End face
93 Spiral torsion spring
94 Spring leg
95 Spring leg
96 Arrow
97 Arrow
98 Double arrow
99 Positioning element
100 End region
101 Wall portion
102 End face
103 End region
104 Positioning projection
105 Arrow
106 Contact surface
107 Contact surface
108 Wall rib
109 Rack and pinion drive
110 Tooth
111 Toothed segment
112 Toothed rack
113 Slide
114 Double arrow
115 Helical compression spring
116 Wall region
117 Contact surface
118 Pressure piston
119 Projection
120 End face
121 Arrow
122 Leaf spring
123 Pivot bearing
124 Spring arm
125 Spring arm
126 Arrow
127 Shoulder web
128 Double arrow
129 Internal wall surface
130 Internal wall surface
131 Side face
132 Side face
133 Guide arrangement
134 Stop surface
135 Stop surface
136 Mid-plane
137 Helical compression spring
138 Spring chamber
139 Arrow
140 Linear seal element
141 Tandem pump
142 Intermediate wall plate
143 Depth

The invention claimed is:

1. Vane pump, in particular a regulatable oil pump for a lubricating system, with a pump housing with at least one housing tank and with a vane rotor disposed in the at least one housing tank mounted so as to be rotatable about a drive shaft in the pump housing constituting an axis of rotation, the vane rotor providing a mount for vanes in approximately radially extending fitting slots, and with an adjusting ring circumferentially bounding pump cells surrounding the vane rotor, wherein the adjusting ring can be displaced via a cylindrical internal wall surface between a concentric position with respect to the vane rotor and an eccentric position with respect to the vane rotor, and with a mutually separate, pressure-tight suction and pressure region, and with a positioning mechanism for regulating a pressure level in a delivery flow, and with a working surface of a cavity disposed circumferentially on the adjusting ring, said cavity being between the adjusting ring and the pump housing, the cavity forming a pressure chamber with a flow connection to a pressure region, wherein the cavity is disposed between a sealing web extending out from an external circumferential surface of the adjusting ring and a pressure-tight pivot bearing arrangement of the adjusting ring constituting a pivot axis, and the sealing web has a sealing surface curving in an arc about the pivot axis, the sealing surface, in conjunction with an oppositely lying sealing surface of a wall part of the pump housing, constituting the second seal arrangement wherein the working surface of the pressure chamber for applying pressure to the external circumference of the adjusting ring constitutes between 5% and 45% of the external circumferential surface of the adjusting ring.

2. Vane pump as claimed in claim 1, wherein the working surface comprises a cross-sectional surface of the cavity formed on the circumference of the adjusting ring.

3. Vane pump as claimed in claim 1, wherein a pivot range of the adjusting ring is restricted via at least one stop arrangement.

4. Vane pump as claimed in claim 3, wherein the at least one stop arrangement comprises at least one stop cam extending out from the external circumferential surface of the adjusting ring.

5. Vane pump as claimed in claim 4, wherein the at least one stop cam co-operates with at least one depression in a wall web of the pump housing to restrict the end positions of the pivot range of the adjusting ring.

6. Vane pump as claimed in claim 1, wherein the positioning mechanism opposes pressure-dependent pivoting movement of the adjusting ring and is a spring arrangement acting between the pump housing and the adjusting ring.

7. Vane pump as claimed in claim 6, wherein a spring force of the spring arrangement can be adjusted by a tensioning device co-operating with the spring arrangement.

8. Vane pump as claimed in claim 7, wherein the tensioning device is an adjusting screw.

9. Vane pump as claimed in claim 1, wherein the pump housing has housing tanks disposed in mirror image by reference to a mid-plane, extending perpendicular to the axis of rotation separated by an intermediate wall plate.

10. Vane pump as claimed in claim 9, wherein vane rotors are disposed in each of the housing tanks drivingly connected by a common drive shaft.

11. Vane pump as claimed in claim 1, wherein the pump housing is integrally formed by a wall plate and a wall web and wherein the pump housing, the rotor body and the adjusting ring are provided in the form of sintered metal bodies.

12. Vane pump as claimed in claim 1, wherein the drive shaft and the vanes are made from alloyed steel.

13. Vane pump as claimed in claim 1, further comprising a housing cover made from an aluminum alloy.

14. Vane pump as claimed in claim 13, wherein the housing cover is made from pressure-cast Al.

* * * * *

UNITED STATES PATENT AND TRADEMARK OFFICE

CERTIFICATE OF CORRECTION

PATENT NO. : 8,545,199 B2
APPLICATION NO. : 11/989654
DATED : October 1, 2013
INVENTOR(S) : Koller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1642 days.

Signed and Sealed this
Fifteenth Day of September, 2015

Michelle K. Lee

Michelle K. Lee
*Director of the United States Patent and Trademark Office*